US005254174A

United States Patent [19]

Hansen et al.

[11] Patent Number: 5,254,174

[45] Date of Patent: * Oct. 19, 1993

[54] METHOD FOR PREPARING A MIXTURE OF SACCHARIDES

[75] Inventors: Ole Hansen; John Jensen, both of Nakskov, Denmark

[73] Assignee: Danisco A/S, Copenhagen, Denmark

[ * ] Notice: The portion of the term of this patent subsequent to Jul. 7, 2009 has been disclaimed.

[21] Appl. No.: 842,196

[22] PCT Filed: Sep. 21, 1990

[86] PCT No.: PCT/DK90/00241

§ 371 Date: Mar. 17, 1992

§ 102(e) Date: Mar. 17, 1992

[87] PCT Pub. No.: WO91/04342

PCT Pub. Date: Apr. 4, 1991

[30] Foreign Application Priority Data

Sep. 22, 1989 [DK] Denmark ..... 4688/89

[51] Int. Cl.[5] ..... C13D 3/14; C13D 1/00

[52] U.S. Cl. ..... 127/53; 127/42; 127/46.2; 127/30; 127/55; 127/66

[58] Field of Search ..... 127/42, 46.2, 55, 30, 127/43, 66, 53

[56] References Cited

U.S. PATENT DOCUMENTS

| | | | |
|---|---|---|---|
| 553,974 | 2/1896 | Weichmann | 127/55 |
| 2,555,356 | 6/1951 | Marchand | 127/34 |
| 3,433,668 | 3/1969 | Hein | 127/66 |
| 3,816,175 | 6/1974 | Melaja | 127/30 |
| 4,138,272 | 2/1979 | Zepeda-Castillo et al. | 127/37 |
| 4,285,735 | 8/1981 | Mitchell et al. | 127/29 |
| 4,421,852 | 12/1983 | Hoehn et al. | 127/43 |
| 4,613,377 | 9/1986 | Yamazaki et al. | 127/39 |
| 5,127,956 | 7/1992 | Hansen et al. | 127/46.2 |

FOREIGN PATENT DOCUMENTS

| | | |
|---|---|---|
| 0201676 | 11/1986 | European Pat. Off. . |
| 0327400 | 8/1989 | European Pat. Off. . |
| 3211776 | 10/1982 | Fed. Rep. of Germany . |
| 2105338 | 3/1983 | United Kingdom . |
| 2179946 | 3/1987 | United Kingdom . |

OTHER PUBLICATIONS

Derwent's abstract, No. 87-305, 414/43, Su 603 061, publ. week 8743 Mar. 30, 1987.

Chemical Abstracts, vol. 26 (1932), p. 5355, Food Ind. 4, 66-9 (1932) Jun.

Chemical Abstracts, vol. 53 (1959), col. 18189c, Cukoripar 12, 126-9 (1959) Dec.

*Primary Examiner*—Theodore Morris

*Assistant Examiner*—P. L. Hailey

*Attorney, Agent, or Firm*—Oblon, Spivak, McClelland, Maier & Neustadt

[57] ABSTRACT

A method for preparing a mixture of fructose, glucose and compounds of the general formula $GF_n$, wherein G is glucose and F is fructose and n is an integer. The mixture is recovered from plant tubers or roots by means of a method which does not involve any chemical modification of the components of the mixture. A juice or syrup comprising fructose, glucose, sucrose and oligosaccharides is subjected at one or more suitable steps to a physical separation process to reduce the amount of fructose, glucose and sucrose. The physical separation may be carried out by chromatography or nanofiltration or both. The mixture is suitable for use in foodstuffs and beverages for human beings and animals.

8 Claims, No Drawings

METHOD FOR PREPARING A MIXTURE OF SACCHARIDES

TECHNICAL FIELD

The present invention relates to a method for preparing a mixture of fructose, glucose and compounds of the general formula $GF_n$, wherein G is glucose and F is fructose and n is an integer, where the mixture is recovered from plant tubers or roots by means of a method which does not involve any chemical modification of the components of the mixture. Furthermore, the present invention relates to the use of such a mixture for preparing a low-calorie foodstuff or beverage for animals or human beings.

BACKGROUND ART

The method according to the present invention is a development of the method disclosed in Danish patent application No. 1592/88, filed 23 Mar. 1988, and the corresponding PCT-application No. PCT/DK89/00065 (WO 89/09288), and relating to a method for preparing a mixture of fructose, glucose and compounds of the general formula $GF_n$, wherein G is glucose and F is fructose and n is an integer, said mixture comprising calculated as dry matter 10–20% by weight of G+F+GF, 10–20% by weight of $GF_2$, 8–15% by weight of $GF_3$, and 72–45% by weight of $GF_4$ and above by recovering said mixture from plant tubers or roots by means of a method which does not involve any chemical modification of the components of the mixture.

The mixture prepared according to DK patent application No. 1592/88 is useful as a low-calorie material with sweet taste.

Sucrose has heretofore been widely used in confectionary and food by virtue of its excellent characteristics, such as good sweetness, body, taste and crystallinity. Sucrose, however, constitutes a substrate for dextransucrase produced by intraoral microorganisms, and, as a result, consecutive intake of sucrose leads to formation of large amounts of insoluble dextran in the mouth. Thereby formation of dental plaque is accelerated. Therefore, sucrose is said to possess cariogenicity. Recently, there has been a trend to reduce the calorie intake for prevention of obesity and a low-calorie sweet material, instead of a high-calorie one, such as sucrose, has been demanded.

For this reason many suggestions have been made as to find a sweet material for replacing sucrose, such as the artifical sweeteners saccharin, cyclamate, aspartame, sorbitol and many others.

Such alternative sweeteners are widely used but also possess several disadvantages, such as a bitter tang or aftertaste. Furthermore, some of the artificial sweeteners are suspected to be carcinogenic.

These disadvantages, especially the suspicion of being carcinogenic—a recurrent subject in the public debate—have made consumers reluctant to use products containing any type of artificial sweetener.

It is known that the dahlia tubers contain a polysaccharide known as inulin. According to Merck Index, 10th edition, Merck & Co. Inc., Rahway, N.J., U S A, 1983, p. 725, Index No. 4872, it has the formula $GF_n$ with n being of an average value of approx. 37. The preparation of inulin from dahlia tubers is disclosed in U.S. Pat. No. 4,285,735.

It is also known that chicory roots and Jerusalem artichoke tubers contain corresponding polysaccharides or oligosaccharides with the general formula $GF_n$. The value of n varies depending on the raw plant material in question, cf. e.g. S. E. Fleming et al. Preparation of high-fructose syrup from the tuber of the Jerusalem artichoke (*Helianthus tuberosus* L.), CRC Crit. Rev. Food Sci. Nutr., 11, 1–23, 1979, U.S. Pat. No. 4,613,377 and EP patent application No. 0 201 676/A2.

The interest in these polysaccharides and oligosaccharides in form of inulin or inulin-like compounds (inulides) has until now been directed to the large contents of fructose moities in said compounds. They are thus a useful source for the preparation of fructose, especially with regard to using fructose as nutrient replenisher and sweetener.

EP patent application 0 201 676 discloses a method for preparing a low-glucose cleavage product from plant parts, said cleavage product comprising inulin-like oligo- or polysaccharides. According to this method the extracted oligo- or polysaccharides are subjected to treatment with the enzyme inulinase in order to decompose them to fructose and fructose-oligomers.

U.S. Pat. No. 4,613,377 discloses a method where the inulin-like oligosaccharides obtained from Jerusalem artichoke tubers or chicory roots are subjected to partial or substantially complete hydrolysis.

Further prior art disclosing the general state of the art comprises the following.

GB patent No. 1,405,987 discloses the preparation of a mixture of fructose and glucose, i.e. invert sugar, by crystallization.

U.S. Pat. No. 2,555,386 discloses the preparation of inulin from Jerusalem artichoke. The inulin obtained is used as a substitute for starch and for the preparation of levulose and alcohol.

U.S. Pat. No. 4,138,272 discloses a method for the preparation of fructose from xerophyte plants, for example agave.

DE Offenlegungsschrift No. 3,211,776 discloses a method for obtaining juice from Jerusalem artichoke to be used for the preparation of hydrocarbons, for example acetone butanol.

Derwent's abstract No. 87-305.414/43, SU patent application No. 306,061 (SU patent No. 1,300,032) discloses the preparation of fructose from Jerusalem artichoke.

Non-patent literature concerning the analyses of "inulin" from Jerusalem artichoke is mentioned in Chemical Abstracts (CA), vol. 26, (1932), p. 5355, Food Ind. 4, 66–9(1932);

CA, vol. 29, (1935), p. 8387, Sovet. Sakhar 1935, No. 1, 4–47;

CA, vol. 50, ( 1956), col. 13152 g, Trudy Komissii Anal. Khim., Akad. Nauk. S.S.S.R., Inst. Geokhim. i Anal. Khim. 6, 492–7(1955);

CA, vol. 51, (1957), col. 9813 a, Zucker-Beih. 3, 86–94(1957);

CA, col 53, (1959), col. 18189 c, Cukoripar 12, 126–9(1959).

GB patent applications Nos. 2,072,679, 2,105,338 and 2,179,946 disclose a low-calorie sweet material comprising a mixture of oligosaccharides with 1–4 molecules fructose bound to sucrose, i.e. a mixture of the oligosaccharides $GF_2$, $GF_3$, $GF_4$ and $GF_5$. The above mixture is prepared by stepwise synthesis from sucrose letting the enzyme fructosyl transferase act upon sucrosa:

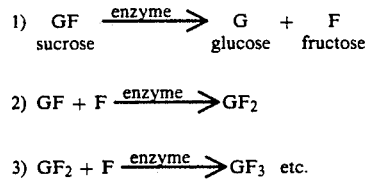

This synthesis is expensive and yields only small amounts of the oligosaccharides $GF_4$ and $GF_5$. Moreover, the above reaction 1) results in the production of an excess of glucose. The known sweet material is available under the name "Neosugar", both in form of a syrup and a powder. "Neosugar" does not possess the detrimental effects of sucrose or alternative artificial sweeteners mentioned above. Its preparation is, however, too expensive to allow wide use thereof. Furthermore, consumers are probably reluctant to use the product if presented as a chemically modified product.

Prior to DK patent application No. 1592/88 there was thus a need for a method allowing the preparation of a sweetener on the basis of a natural mixture without the detrimental effects of sucrose and conventional alternative sweeteners, said method being inexpensive and not involving chemical modification of the desired natural components in the starting materials.

It was shown that a material in form of a mixture of saccharides satisfying these needs could be prepared from a natural raw material, i.e. plant tubers or roots, e.g. tubers of the Jerusalem artichoke, *Helianthus tuberosus* L. or roots of chicory, Cichorium.

Accordingly DK patent application No. 1592/88 discloses a method for preparing a mixture of fructose, glucose and compounds of the general formula $GF_n$, wherein G is glucose and F is fructose and n is an integer, said mixture comprising calculated as dry matter 10–20% by weight of G+F+GF, 10–20% by weight of $GF_2$, 8–15% by weight of $GF_3$, and 72–45% by weight of $GF_4$ and above by recovering said mixture from plant tubers or roots by means of a method which does not involve any chemical modification of the components of the mixture.

By using the above method it is possible to prepare the mixture of saccharides in form of a dry powder at a price of less than half the costs involved in the preparation of the mixture known from GB patent application No. 2,072,679 according to the methods disclosed in GB patent applications Nos. 2,072,679, 2,105,338 and 2,179,946.

The composition of the mixture prepared by the above method differs from the composition of inulin derived from dahlia tubers by having a lower degree of polymerisation. Thus the ratio F/G is 3–4 for the above as compared to inulin where the ratio F/G is approx. 30.

An essential requirement for any material used as sweet material is its water-solubility. The above mixture has a composition or degree of polymerisation within such limits that, on the one hand, the constituents are sufficiently large to pass predominantly undigested through the alimentary tract. On the other hand, the constituents are still water-soluble. The inulide mixture obtained from dahlia tubers is not soluble in water in its unmodified form, and has thus to be subjected to chemical or other modification, such as hydrolysis, if a water-soluble product is desired.

The mixture prepared according to the above method has a good combination of sweetening effect, water solubility and indigestibility. However, when the sweetening effect is of minor importance and/or an especially low calorie content is desired it would be desirable to reduce the content of fructose, glucose and sucrose.

The method according to DK patent application No. 1592/88 is described in greater detail below.

The mixture is obtained from plant tubers or roots, preferably tubers, of Jerusalem artichoke (*Helianthus tuberosus* L.) or roots of chicory because these plants give a high yield of the mixture of the mentioned composition. When the Jerusalem artichoke is cultivated in a temperate climate the tubers harvested during the major part of the harvesting season result in a mixture of a almost constant composition.

The mixture is advantageously prepared in form of a dry powder, thus enabling an easier handling and a more stable product. It is, however, also possible to use the mixture in form of a juice or syrup, especially for industrial use, when shipment in large amounts, e.g. in a tank, directly to the user is possible and convenient. In this case the problems in connection with the removal of the remaining water are avoided.

The mixture can be prepared from Jerusalem artichoke tubers or roots of chicory by first preparing a syrup, i.e. a concentrated solution with a dry matter content of between 65 and 80% by weight. The syrup is then evaporated further and dried until the desired powdery product is obtained.

Syrup from Jerusalem artichoke tubers or roots of chicory can be prepared in a manner resembling conventionally used methods for the preparation of sucrose syrup from sugar beets. It is thus possible to perform this part of the production with a conventional sugar beet plant. This is advantageous in that the capacity of existing plants is considerably larger than is demanded on the world market. It is thus possible to use this free capacity for the preparation of the inulide mixture.

Syrup from Jerusalem artichoke tubers or roots of chicory is prepared as follows. Stones, green parts and soil are removed from Jerusalem artichoke tubers or roots of chicory and the tubers or roots are cut into cosettes. These are extracted with water in a so-called DDS-diffusor, i.e. a trough with a steam mantle. The trough has a small inclination and is provided with a twin screw for the transport of the cosettes counter to the flow of water. The extraction is performed at 60°–85° C. and the desired mixture is transferred to water in dissolved form. Part of the protein content is denaturated, thus rendering it insoluble. Enzymes present in the solution are also denaturated and thus inactivated so that they cannot decompose the desired mixture. The aqueous extract has a dry matter content of 10–17% by weight.

Impurities, such as pectin, proteins and cell material, are removed from the extract by adding slaked lime, $Ca(OH)_2$, up to a pH-value of 10.5–11.5. After adding the slaked lime the following alternatives are open:

1. filtration followed by adjusting the pH value by adding $CO_2$ or phosphoric acid and subsequent filtration, or
2. adding $CO_2$ or phosphoric acid and subsequent filtration, i.e. the extract is only filtered once.

In a further embodiment the extract is treated with slaked lime in two steps, i.e. it is subjected to a pretreatment and to a main treatment with slaked lime. Then $CO_2$ is added followed by filtration. Then $CO_2$ is added again followed by filtration. The above filtration steps can of course also be carried out by technically equivalent separation methods.

Salts and colours may be removed by means of ion exchange. Residues of colours and undesired taste and odoriferous compounds may be removed by subsequent treatment with active carbon.

The purified extract with a dry matter content of 8–14% by weight can be subjected to hyperfiltration (reverse osmosis) in order to remove water up to a dry matter content of approx. 25–30% by weight. In a multi-step evaporator, such as a falling film evaporator, the extract is subsequently concentrated to a syrup with a dry matter content of 75–85% by weight.

This syrup is further evaporated to a dry matter content of 91–96% by weight by means of evaporation e.g. in a vertical vacuum dryer or a thin film evaporator.

On the basis of such a syrup the mixture is prepared in form of a dry powder by using one of two alternative methods, i.e. one termed "drying with quenching" and one termed "vacuum flash drying". These methods are generally suitable for the concentration of syrup-like materials, and are subject matter of the DK patent applications Nos. 1593/88 and 1594/88, respectively, both filed 23 Mar. 1988.

It is thus possible to prepare the above inulide mixture in form of a dry powder. Such a dry powder is bacteriologically stable. High osmotic pressure is required for obtaining bacteriological stability. For the relatively high molecular weight oligosaccharides a high osmotic pressure is first obtained at a high dry matter content.

A liquid mixture with a sufficiently high dry matter content is difficult to handle in the preparation step as well as during the application of said mixture, as it has an almost paste-like consistency resembling soft toffee mass. Consequently such a mixture flows very slowly without solidifying and is very sticky. As mentioned above, however, it is possible to use the mixture in form of a juice or syrup if the above problems are of no importance, e.g. in case of industrial use in large amounts.

The dry mixture obtained by one of the methods disclosed in DK patent applications Nos. 1593/88 and 1594/88 can successfully be used as a partial or complete substitute for sugar and other sweet materials including sorbitol.

The method for the preparation of the mixture in form of a dry powder comprises carrying out the following steps:

a) the substantially cleaned tubers or roots are cut into cosettes,
b) the cosettes are subjected to extraction with water,
c) the extract, or juice, is treated in a suitable order one or more times by each of the following steps:
   1) addition of $Ca(OH)_2$,
   2) addition of $CO_2$ or phosphoric acid, and
   3) filtration,
d) the juice from step c) is subjected to ion exchange,
e) the juice from step d) is optionally treated with active carbon,
f) the juice from step d) or e) is optionally concentrated by hyperfiltration,
g) the juice from step d), e) or f) is evaporated to a syrup with a dry matter content of 91–96% by weight,
h) the syrup is dried to a powder.

For overcoming the difficulties during the evaporation of the high-concentrate syrup, step h) is advantageously carried out by one of the following methods, i.e. either i) the syrup is distributed as a thin layer on a cooling surface with a temperature of below 0° C., preferably between minus 10° C. and 0° C., whereby the syrup solidifies to a hard, glass-like mass,
k) the hard, glass-like mass formed in step i) is scraped off the cooling surface in form of flakes,
l) the flakes are roughly ground and
m) the roughly ground flakes are dried at a temperature of below 60° C. to a dry matter content of above 96% by weight, preferably above 97% by weight, or
n) the temperature of the syrup is adjusted to a value below the boiling point of said syrup at atmospheric pressure,
o) the syrup is fed into a vacuum chamber,
p) the syrup is led through the vacuum chamber without any heat supply to the syrup,
q) the obtained dried or evaporated mixture is removed from the vacuum chamber through an air lock.

If it is possible to use the mixture as a juice, only the above steps a)–f) is carried out. Then the juice can be evaporated to a syrup if desired. In this way the problems connected with removing remaining water are avoided.

As mentioned before, there is a demand for removing or at least reducing the content of mono- and disaccharides, in the mixture of inulides prepared according to DK patent application No. 1592/88. This is due to i.a. the above-mentioned desire to reduce the calorie content and cariogenic effect of lower saccharides, while at the same time retaining the preferred inulides. Accordingly, the inulide compounds of formula $GF_2$ and above are especially desirable. Such compounds are beneficial to ones health, since, like fibers, they pass the alimentary tract without being digested. In contrast to the result of ingestion of lower saccharides a violent increase of the glucose level is avoided, the latter being an important risk factor with diabetes. At the same time the preferred inulides support the growth of bacteria of the genus Bifidobacterium naturally occuring in the intestinal flora. Moreover the preferred inulides act as bulking agents in foodstuffs. This is of particular importance for an attractive texture of the foodstuff in question. On the other hand, it can also be desirable to remove higher oligosaccharides, such as $GF_n$, $n>10$, to improve the water-solubility of the mixture.

DISCLOSURE OF THE INVENTION

The object of the present invention is to solve the problems arising from the method disclosed in DK patent application No. 1592/88.

The object of the invention is accomplished by a method characterized by subjecting at one or more suitable steps a juice or syrup comprising fructose, glucose, sucrose and oligosaccharides to a physical separation process during one or more suitable steps to reduce the amount of fructose, glucose and sucrose.

When carrying out the method according to the invention the resulting inulide mixture has a more suitable composition than the mixture obtained by the method according to Danish patent application No. 1592/88. The inventive method does not involve any chemical modification of the components of the mixture either, which as mentioned above can be of great importance for the product to be accepted by the consumer.

A further advantage of the inventive method is the removal of salts during the physical separation process resulting in a reduction of costs involved in ion exchange of the juice during the above step c). Either the volume of the ion exchanger can be reduced or more juice can be treated before the ion exchanger has to be regenerated.

The removal of sucrose, glucose and fructose by the inventive method allows a reduction of calories, such as from about 2.5 kcal/g to 1.5-2.2 kcal/g.

The physical separation also allows a standardization of the mixture, i.e. a uniform composition is ensured regardless of the raw material chosen or its composition, which can for instance be depended on the time of harvest. Consequently production cost can be considerably reduced and a longer production period can be envisaged so that existing apparatuses can be more efficiently used.

According to the present invention it is possible to obtain a mixutre with a preferred composition comprising calculated as dry matterk 0-10% by weight of G+F+GF,
5-20% by weight of $GF_2$,
5-15% by weight of $GF_3$,
5-15% by weight of $GF_4$,
5-15% by weight of $GF_5$, and
80-25% by weight of $GF_6$ and above.

Advantageously the physical separation is carried out by chromatography or nanofiltration or both. The order in which the steps are carried out is not critical. Thus chromatography or nanofiltration may be used alone or advantageously in combination in any given order.

According to the invention tubers of Jerusalem artichoke (*Helianthus tuberosus* L.) and roots of chicory (Cichorium) can be used to recover the mixture, resulting in a high yield of an advantageous composition.

Depending on the application of the mixture, the latter can be prepared in form of a juice, a syrup or a dry powder.

When carrying out the method according to the invention by a) cutting the substantially cleaned tubers or roots into cosettes,
b) subjecting the cosettes to extraction with water,
c) treating the extract, or juice, in a suitable order one or more times by each of the following steps:
   1) addition of $Ca(OH)_2$,
   2) addition Of $CO_2$ or phosphoric acid, and
   3) filtration
d) subjecting the juice from step c) to ion exchange,
e) optionally treating the juice from step d) with active carbon,
f) optionally concentrating the juice from step d) or e) by hyperfiltration,
g) optionally evaporating the juice from step d), e) or f) to a syrup, and
h) optionally drying the syrup to a powder, the physical separation is advantageously carried out during any suitable moment subsequent to step c) but prior to step h). In case the physical separation is carried out prior to ion exchange according to step d) the costs involved with ion exchange can be reduced, since the mixture has been partially desalinated by the physical separation.

Advantageously the physical separation may be carried out by chromatography, preferably by chromatography of the juice or syrup using an ion exchange resin and water as eluant, whereupon the eluted fractions with low sucrose content are treated in accordance with any of the subsequent steps. A particular advantage of chromatography is the possibility of simultaneous removal of or reduction of the amount of higher molecular weight compounds, for instance compounds of the formula $GF_n$, where $n>10$.

In an other advantageous embodiment of the invention the physical separation is carried out by nanofiltration, preferably by nanofiltration of a juice or syrup, whereupon the retentate is treated in accordance with any of the subsequent steps.

In the present specification and claims nanofiltration denotes filtration with a membrane having a NaCl-permeability of 30-100% at 20° C. and 10-60 bar. The NaCl-permeability is determined by using the following equation:

$$\text{NaCl-permeability} = \frac{\text{NaCl conc. in permeate}}{\text{NaCl conc. in concentrate}} \times 100\%$$

Nanofiltration also results in the removal of low molecular weight proteins and amino acids, so that the purity of the inulide mixture is improved. The discarted fractions containing sucrose and protein are suitable for animal feed.

The mixture prepared according to the invention is suitable for incorporation in a low-calorie foodstuff or beverage for animal or human use. The resulting product is very healthy due to the reduced content of low saccharides. At the same time the organoleptic properties of such foodstuffs are often improved.

As mentioned above, it is not critical when or in which order the physical separation is carried out. In a preferred embodiment of the invention the physical separation is carried out after treatment of the juice with slaked lime and filtration according to step c) and before the ion exchange according to step d). In this case the physical separation may be performed by nanofiltration alone, by chromatography alone, by nanofiltration followed by chromatography or by chromatography followed by nanofiltration. All these possibilities result in a reduced content of salt, sugar, protein and water. The reduced salt content again results in the subsequent ion exchange becoming less expensive.

In a further embodiment the decoloured juice of step e) with or without partial evaporation is subjected to the physical separation. This constitutes either a supplementary or alternative measure. In this embodiment the physical separation can advantageously be performed by chromatography alone, by ultrafiltration followed by chromatography and by chromatography followed by ultrafiltration.

Chromatography is advantageously carried out on a cation exchange resin in the $Na^{+}-$, $K^{+}-$, $Ca^{++}$ or $Mg^{++}$ form, such as a "Duolite TM" C204, C207 or C211 or a "Dowex TM" cation exchange resin. The mixture fed to the ion exchanger can have a dry matter content of 10 to 80% by weight. Chromatography can be carried out at any suitable temperature, for instance in the range of from 20° to 80° C. Chromatography is performed at a flux velocity of 0.1 to 1 ion exchanger volume/h. The mixture is added until the ion exchange resin has been charged with 10 to 100 g dry matter per liter. During elution the sucrose content of the fractions is monitored by means of a refractometer on the output side of the chromatography column.

Nanofiltration is carried out with membranes having a NaCl-permeability of 30 to 100% at 20° C. and 10–60 bar. Suitable membranes include HC50 PP available from DDS Filtration, DK-4900 Nakskov, and Desal-5 available from Desalination Systems, 1238 Simpson Way, Escondido, Calif. 92025, USA. Nanofiltration can be carried out at 10°–80° C. with a pressure of 10–60 bar.

The mixture prepared according to the inventive method is suitable for the preparation of low-calorie human or animal foodstuffs and beverages. According to the present specification with claims foodstuffs and beverages include all types of products suitable for human or animal intake, i.e. also pharmaceutical preparations.

Examples for products where the mixture is usable include chewing gum, chocolate, ice cream, liquorice, cakes, all types of biscuits, canned food, marmelade and jams, soft drinks, pharmaceutical preparations and various other foodstuffs and beverages.

The mixture obtained by the inventive method has a sweetening effect, corresponding to 0.03–0.3 × the one of sucrose, without possessing any tang or aftertaste. Such a sweetening effect being lower than that of sucrose is advantageously employed in products where a large amount of saccharides is desirable with respect to body and texture. Examples of such products include liquorice and certain types of chocolate, where the same amount of sucrose would render such products oversweet. The mixture passes the alimentary tract substantially without being digested thus providing the organism with a very low amount of calories. The mixture also increases the rate with which the food passes the alimentary tract, thus reducing the overall intake of calories. The mixture thus acts as a filler or bulking agent in the alimentary tract in the same way as dietary fibers, i.e. it increases the fecal excretion of sterols and volatile fatty acids and lowers the serum level of cholesterol and triacylglycerol. Furthermore the mixture supports the growth of bacteria of the genus Bifidobacterium and other beneficial microorganisms of the natural intestinal flora. Moreover, it has been found that this type of mixture has no laxative effects, even when given in an amount of 1 g/kg body weight/day.

Due to the above beneficial effects on the gastrointestinal tract it is also possible to use the mixture as a pharmaceutical preparation for the improvement of the intestinal function. Such preparations can be in form of conventional formulations, e.g. as tablets, dragees, capsules and the like. In case of microorganisms able to utilize the mixture as a carbohydrate source, the mixture can also be used in nutritive media for the cultivation of such microorganisms.

Further scope of applicability of the present invention will become apparent from the detailed description given hereinafter. However, it should be understood, that the detailed description and specific examples, while indicating preferred embodiments of the invention, are given by way of illustration only, since various changes and modifications within the spirit and scope of the invention will become apparent to those skilled in the art from this detailed description.

BEST MODE FOR CARRYING OUT THE INVENTION

The method according to DK patent application No. 1592/88 and the method according to the present invention as well as the use of mixtures obtained by the inventive method are described in greater detail in the following Examples, where reference Examples are denoted by letters and Examples according to the present invention are denoted by numerals.

EXAMPLE A: PREPARATION OF A SYRUP

The harvested tubers of the Jerusalem artichoke are treated on a conventional plant for treating sugar beets. The treatment includes the following steps.

1. Feeding and removal of stones and grass

The tubers are emptied into a beet yard and flow into the plant, while stones as well as green plant material (i.e. grass and stem material) are removed. Most of the soil is also washed off.

2. Cutting

For preparing the tubers for the subsequent extraction process said tubers are cut into cosettes with a cross-section of approx. 0.5×0.5 cm. Their length depends on the size of the tubers (typically 2–5 cm). The cutting process is performed on a conventional sugar beet cutter. It can, however, be necessary to use other knives.

3. Extraction

In order to extract the desired mixture from the cosettes, the extraction process is performed analogous to the one known from the extraction of sugar from sugar beets. The extraction is performed in a so-called DDS-diffusor, a trough with a steam mantle. The trough has a small inclination and is provided with a twin screw ensuring transport of the cosettes.

The cosettes are extracted according to the counterflow principle, i.e. the cosettes are fed through a funnel in the bottom part of the trough. Water as well as the press juice obtained in step 4 are fed into the top part of the trough.

The cosettes are then transported counter to the flow of water, whereby oligosaccharides and other water-soluble components, such as salts and proteins, pass into the water phase.

The temperature during the extraction is between 60°–85° C. Such a high temperature ensures not only a good solubility of oligosaccharides but also partially denaturates the protein as to render it insoluble. Enzymes are also denaturated and thus inactivated at this temperature.

The dry matter content of the extract is 10–17% by weight.

4. Pressing of the pulp

The extracted cosettes are pressed in a special press of the type also used for conventional sugar beet processing. This is done to increase both the yield of oligosaccharides as well as the dry matter content of the pulp. The pulp has often to be dried with respect to stability during transport and storage until use, e.g. in form of foodstuffs. The increase in yield is achieved by transferring the press juice back to the extraction process, as described above.

5. Purification of the juice

The juice obtained by the extraction process is turbid since it contains particulate and colloidal material. Amongst the impurities present are pectin and proteins as well as cell material from the cosettes.

In order to remove these impurities slaked lime, $Ca(OH)_2$ is added up to a pH-value of 10.5–11.5 thereby precipitating a part of the impurities.

The pH-value is lowered again by adding $CO_2$ or phosphoric acid either before or after filtration. Thus excess calcium is precipitated either as calcium carbonate or calcium phosphate. The pH-value after this treatment is between 8.0 and 9.5. The juice is subsequently filtered. The temperature during the lime treatment is 35°-40° C. and during the lowering of the pH-value and the filtering it is 60°-80° C. Precipitation and filtering are improved at the higher temperature.

The purification of the juice is performed using the same equipment as in conventional sugar beet processing.

After the purification the dry matter content is 9-16% by weight.

6. Ion exchange

After the purification the juice still contains salts (3-8% by weight of the total dry matter) and it is brownish or greenish in colour. It is thus subjected to a cation as well as an anion exchange.

The cation exchange (e.g. on a "Duolite TM"-C20 resin) is performed at a temperature of 25°-35° C. in order to avoid hydrolysis of the oligosaccharides.

During the anion exchange (e.g. on a "Duolite TM" A-378 resin) the coloured compounds of the juice are also removed as to render said juice a colourless oligosaccharide solution. The dry matter content after the ion exchange is 8-14% by weight.

7. Treatment with active carbon

It may be necessary to treat the ion-exchanged juice with active carbon in order to remove possible residues of coloured compounds, undesired taste or odoriferous compounds.

8. Evaporation

Before the actual evaporation it is advantageous to employ hyperfiltration (reverse osmosis) in order to remove part of the water so that the dry matter content is up to approx. 25% by weight. By this step a more gentle treatment is obtained.

The evaporation is performed in a multi-step evaporator such as a falling film evaporator. The juice is evaporated to a syrup of a dry matter content of between 75-85% by weight.

Thereafter the syrup is evaporated in a vertical vacuum evaporation to a dry matter content of 91-96% by weight.

EXAMPLE B

Tubers of Jerusalem artichoke are treated as described in Example A under the following conditions. The extraction temperature is 70° C. The dry matter content of the extracted juice is 12% by weight. $Ca(OH)_2$ is added at 35° C. to pH 11.5 and the pH value is then lowered to 9 by adding $CO_2$. Then the juice is filtered at 60° C. After ion exchange at 25° C. on "Duolite TM" C20 and "Duolite TM" A-378 and treatment with active carbon the juice has a dry matter content of 9% by weight due to dilution during ion exchange. The juice is hyperfiltrated to a dry matter content of 25% by weight, and then evaporated first in a falling film evaporator to 85% by weight and then to 92.6% by weight in a thin film evaporator (model LUWA, available from Buss-SMS, Kaiserstr. 13-15, D-6308 Butzbach).

EXAMPLES C AND D: PREPARATION OF A MIXTURE IN FORM OF A DRY POWDER

Method 1: "Drying with Quenching"

EXAMPLE C

A syrup is used having a dry matter content of 94.3% by weight obtained according to the method of Example A being of a temperature of 90° C., at which temperature the syrup is liquid.

The syrup, almost representing a melt, is transferred to the outer surface of a cooling drum in form of a thin layer. The temperature on the surface of the cooling drum is minus 8° C.

The syrup solidifies to form a glass-like mass and does not form crystals, as conventional sugar solutions do.

The hard, glass-like material is scraped off the cooling drum in form of flakes. These flakes are roughly ground (granulated) 4nd subsequently dried in a fluid bed dryer at a temperature of below 60° C. to a dry matter content of 96.2% by weight.

The material can subsequently be ground to a desired grain size, such as below 250 μm.

Method 2: "Vacuum Flash Drying"

EXAMPLE D

A syrup having a dry matter content of 91-93% by weight obtained according to the method of Example A and being of a temperature of 80°-100° C. is transferred to a vacuum chamber provided with a conveyor belt.

By adjusting the dry matter content and the temperature of the feeding material as well as the vacuum in the chamber the obtained mixture has a temperature of 30°-40° C. after evaporation of water and is solid. The heat of evaporation is derived from the enthalpy of the feeding material, i.e. it is not necessary to add heat during the drying process.

At an absolute pressure of 23.8 or 42.2 mmHg the mixture leaves the vacuum chamber at a temperature of approx. 30° C. or approx. 40° C. respectively.

The process can be described as a flash-like evaporation in vacuum, the feed being a syrup and the final product a dry powder.

The above process differs from conventional flash evaporation by being performed in vacuum, thus rendering it unnecessary to overheat the feeding material, and by the feeding material being a solution and not a wet, particulate matter.

An interesting property of this drying method is the fact that the mixture is cooled to a desired final temperature of typically 30°-40° C. during the drying/water evaporation.

EXAMPLE E

Roots of chicory are treated as described in Example A under the following condition. The extraction temperature is 75° C. The dry matter content of the extracted juice is 13% by weight. $Ca(OH)_2$ is added at 35° C. to pH 11.0 and the pH value is then lowered to 9 by adding $CO_2$. Then the juice is filtered at 70° C. After ion exchange at 25° C. on "Duolite TM" C20 and "Duolite TM" A-378 and treatment with active carbon the juice has a dry matter content of 9.5% by weight due to dilution during ion exchange. The juice is hyperfiltrated to a dry matter content of 25% by weight, and then evaporated first in a falling film evaporator to 85% by weight and then to 92.3% by weight in a thin film evaporator (model LUWA, available from Buss-SMS, Kaiserstr. 13-15, D-6308 Butzbach). The obtained syrup is adjusted to 98° C. and is fed into a vacuum chamber with free fall. The absolute pressure in the vacuum chamber is 38 mmhg. The dry powder leaving the chamber has a dry matter content of 97% by weight and a temperature of 38.5° C.

EXAMPLE 1

Chromatography

Example A, steps 1–7, is carried out, i.e. including the treatment with active carbon. The purified juice is transferred to an ion exchange resin "Duolite TM" C 204-Na. Then the inulide mixture is eluted with water. The dry matter content of the juice as well as of the fractions of the eluate are determined by refractomy. The sucrose content of the juice as well as of the fractions of the eluate are determined by the HPLC method where the sample is transferred to a LICHROSORB column (amin form) having a diameter of 7 mm and a length of 25 cm. The eluant is an acetonitrile/water mixture having a volume ratio of 67:33. A RI (refraction index) detector is used. The accumulated amounts appear from Table 1.

TABLE 1

| fraction No. | accumulated dry matter % by weight of dry matter in juice | accumulated sucrose % by weight of acc. dry matter |
|---|---|---|
| 1 | 3.9 | 0.0 |
| 2 | 14.3 | 0.0 |
| 3 | 31.4 | 0.0 |
| 4 | 50.6 | 0.8 |
| 5 | 69.9 | 3.7 |
| 6 | 83.4 | 9.9 |
| 7 | 92.3 | 14.9 |
| 8 | 97.7 | 17.4 |
| 9 | 99.4 | 19.0 |

Fractions 1–5 having a sucrose content of 3.7% by weight of dry matter are combined and evaporated as described in Example A, step 8, whereupon the mixture is dried as described in Example D.

When analysed the product had the following composition:

| | |
|---|---|
| dry matter | 96.2% by weight |
| ash | 0.0% by weight |
| glucose | 0.0% by weight |
| fructose | 0.0% by weight |
| sucrose | 3.7% by weight |
| $GF_2$ | 8.3% by weight |
| $GF_3$ | 10.0% by weight |
| $GF_n$* | 78.0% by weight |

*n ≧ 4

Apart from the result for dry matter, all results are given in % by weight of dry matter.

EXAMPLE 2

NANOFILTRATION

Example A, steps 1–5, is carried out, i.e. including the purification of the juice. The purified juice is nanofiltered using a nanofiltration membrane HC50 PP available from DDS Filtration, DK-4900 Nakskov, having an NaCl permeability of 40–60% at 20° C. and 40 bar. The juice is concentrated twice and diafiltered at 50° C. and 20 bar, the amount of water used being 200% by weight of the amount of feed solution.

The results after the nanofiltration are given in Table 2.

TABLE 2

| | juice feed | retentate from nanofiltration |
|---|---|---|
| dry matter content (% by weight) | 10.5 | 24 |

TABLE 2-continued

| | juice feed | retentate from nanofiltration |
|---|---|---|
| ash at 550° C. (% by weight/dry matter) | 11.4 | 5.6 |
| inulide purity* (% by weight/dry matter) | 85 | 90 |
| sucrose + glucose + fructose (% by weight/dry matter) | 20 | 12 |

*Inulide purity is the content of glucose + fructose + $GF_n$ compared to the entire dry matter content. Inulide purity is determined by hydrolysis and subsequent analysis of glucose + fructose.

As is apparent the content of sucrose, glucose and fructose as well as ash is considerably reduced. The reduced ash content is due to the fact that salts and proteins are also removed.

The evaporation of the permeate results in a molasses-like product containing

76% by weight dry matter

35% by weight sucrose+glucose+fructose

7% by weight protein, and

44% by weight ash.

This product is suitable for animal food.

The above retentate is treated as described in Example A, starting with step 6, the volume of the ion exchanger being considerably reduced since the salt content has already been considerably reduced. The syrup is then dried as described in Example D.

When analysed the product had the following composition:

| | |
|---|---|
| dry matter | 95.4% by weight |
| ash | 0.0% by weight |
| glucose | 0.0% by weight |
| fructose | 0.0% by weight |
| sucrose | 4.3% by weight |
| $GF_2$ | 9.5% by weight |
| $GF_3$ | 11.2% by weight |
| $GF_n$* | 75.0% by weight |

*n ≧ 4

Apart from the result for dry matter, all results are given in % by weight of dry matter.

EXAMPLE 3

Chromatography

Example A, steps 1–5, is carried out, i.e. including the purification of the juice. The purified juice is evaporated up to a dry matter content of 50% by weight and chromatographed on an ion exchange resin of the type "Duolite TM" C204-Na. The column is eluted with water to obtain a fraction having a reduced sucrose content of 7.8% by weight of dry matter. The composition of the feed mixture, the product fraction and the rest fraction appear from the following Table 3.

TABLE 3

| | feed mixture | product fraction | rest fraction |
|---|---|---|---|
| % by weight dry matter/ dry matter content of feed mixture | 100 | 82 | 18 |
| % by weight sucrose/ dry matter | 16.7 | 7.8 | 57.2 |
| % by weight ash/ dry matter | 11.4 | 11.4 | 11.4 |

The product fraction is treated in accordance with remaining steps of Example A, i.e. steps 6–8, and dried according to Example D. The resulting product has a sucrose content of 8.8% by weight of dry matter and further contains 0% ash.

The rest fraction can be treated as above and incorporated in human or animal foodstuffs and beverages. Subsequent to evaporation the sucrose content of the rest fraction is 64.6% by weight of dry matter and further contains 0% ash.

EXAMPLE 4

Chromatography Followed by Nanofiltration

The product fraction and the rest fraction of Example 3 are subjected to nanofiltration as described in Example 2.

The composition of the product fraction before and after nanofiltration at 50° C. and 15 bar is as follows:

TABLE 4

| | product fraction of Example 3 | retentate of nanofiltration |
|---|---|---|
| % by weight dry matter | 20 | 24 |
| % by weight ash/ dry matter | 11.4 | 5.6 |
| inulide purity (% by weight/dry matter) | 85 | 90 |
| sucrose + glucose + fructose (% by weight/ dry matter) | 7.8 | 3 |

As is apparent a further reduction of sucrose+glucose+fructose is obtained when using chromatography followed by nanofiltration.

Subjecting the rest fraction to nanofiltration at 60° C. and 40 bar, the composition of the resulting product is as follows:

TABLE 5

| | rest fraction of Example 3 | retentate of nanofiltration |
|---|---|---|
| % by weight dry matter | 12 | 24 |
| % by weight ash/ dry matter | 11.4 | 5.5 |
| inulide purity (% by weight/dry matter) | 85 | 90 |
| sucrose + glucose + fructose (% by weight/ dry matter) | 57.2 | 55 |

EXAMPLE 5

Nanofiltration Followed by Chromatography

The retentate of Example 2 is subjected to chromatography as described in Example 1. The result is as follows:

TABLE 6

| | feed mixture | product fraction | rest fraction |
|---|---|---|---|
| % by weight dry matter/ dry matter content of feed | 100 | 92 | 8 |
| % by weight sucrose/ dry matter | 12 | 8.5 | 52.3 |
| % by weight ash/ dry matter | 6.2 | 6.2 | 6.2 |

The product fraction is treated in accordance with the remaining steps of Example A, and dried according to Example D. The resulting product has a sucrose content of 9.4% by weight of dry matter and further contains 0% ash. Thus subjecting a nanofiltered juice to chromatography results in a product fraction comprising 92% of the dry matter in the juice. The dry matter content of the product fraction obtained by chromatography of the non-nanofiltered juice is, on the other hand, 69.9%. The yield after nanofiltration is 86% by weight of the dry matter of the juice. The combination of nanofiltration and chromatography results thus in an increased yield of 92%×86%=79.1% compared to the above 69.9% obtained by chromatography alone.

Subsequent to evaporation and drying the rest fraction has a sucrose content of 58.1% by weight of dry matter and contains 0% ash. The evaporated and dried rest fraction is suitable to be incorporated in human and animal foodstuffs and beverages.

EXAMPLE 6

The mixtures prepared as described in Example C and 1 as well as the commercially available products "Neosugar"-syrup and "Neosugar"-powder have, according to an analysis, the following composition, cf. Table 7. All analysis results of the carbohydrates are given in relation to the dry matter content. All values in Table 7 are in % by weight.

TABLE 7

| | "Neosugar-" syrup | "Neosugar" powder | mixture Ex. C | mixture Ex. 1 |
|---|---|---|---|---|
| dry matter | 79.0 | 96.4 | 96.2 | 96.2 |
| ash | 0 | 0 | 0 | 0 |
| glucose | 29.5 | 1.1 | 1.3 | 0 |
| fructose | 1.7 | 0.8 | 1.9 | 0 |
| sucrose | 10.6 | 2.8 | 15.8 | 3.7 |
| $GF_2$ | 28.0 | 36.4 | 12.9 | 8.3 |
| $GF_3$ | 30.2 | 58.9 | 11.1 | 10.0 |
| $GF_n$* | 0 | 0 | 57.0 | 78.0 |

*$n \geqq 4$

On the basis of the experimental results with respect to "Neosugar" described in an article of T. Tokunaga et al., *J. Nutr. Sci. Vitaminol.*, 32, 111–121, 1986, it is evident, that the laxative effect of the compounds of the general formula $GF_n$, where $n>2$, is more extensive at a lower molecular weight.

It has thus to be assumed that the mixture according to Example C is less laxative than "Neosugar".

The most laxative component is presumably $GF_2$. The content of this component in "Neosugar" is 28.0% and 36.4% respectively and there is 10.8% in the mixture of Example C. In the mixture according to Example 1 the content has been further reduced to 8.3%.

EXAMPLE 7

Chewing Gum

The sugar content in a conventional chewing gum was replaced by a combination of the mixture prepared according to Example 1 and aspartame. It was found that this chewing gum possessed better organoleptic properties, especially with regard to "mouthfeel" or texture and rest volume, i.e. the volume left after chewing of a chewing gum for a predetermined period of time, than corresponding chewing gums comprising sucrose.

EXAMPLE 8

Sweets

Sweets with the following basic formulation, wherein 67% of the sucrose were replaced by the mixture of Example 5, were prepared.

Basic formulation:

100 g sucrose
200 g mixture of Example 5
120 g glucose
100 g water

The basic formulation was boiled down while heating to 170° C.

The basic formulation was subsequently cooled and flavourings were added just before the formulation could no longer be kneaded. Amongst the flavourings used were peppermint oil, aniseed oil, eucalyptus oil or others.

After the kneading in of the flavourings the resulting formulation was cut into the desired form and left to stiffen.

The sweets prepared according to this method were less sweet and had a lower calorie content than conventional sweets.

EXAMPLE 9

Cake Formulation

In this formulation 35% of the sucrose content were replaced by the mixture of Example 2. The following recipy was used:

| | regular cake formulation | formulation with mixture of Ex. 2 |
|---|---|---|
| margarine | 250 g | 250 g |
| flour | 250 g | 250 g |
| sugar (sucrose) | 200 g | 130 g |
| mixture of Example 2 | — | 70 g |
| eggs | 6 | 6 |

The cakes were both baked for 1.25 h at 150° C. in a circulating air oven. The results were as follows. There was no difference during the preparation of the dough. The cake formulated with the mixture of Example 2 was less sweet, but apart from that both cakes tasted alike.

EXAMPLE 10

Chocolate

| | regular formulation | formulation with mixture of Ex. 4 |
|---|---|---|
| cocoa mass | 39.4% | 39.4% |
| cocoa butter | 2.0% | 2.0% |
| vegetable fat | 3.0% | 3.0% |
| milk powder (25% fat) | 3.0% | 3.0% |
| butter fat | 3.0% | 3.0% |
| lecithin | 0.57% | 0.57% |
| vanillin | 0.01% | 0.01% |
| sodium saccharide | — | 0.02% |
| mixture of Example 4 | — | 49.0% |
| sucrose | 49.02% | — |

The only difference between the two chocolates is the lower calorie content of the inulide-containing chocolate and the two chocolates have the same sweetness.

EXAMPLE 11

Chocolate

In the chocolate formulation of Example 10 the mixture of Example 4 was substituted by a mixture prepared from roots of chicory according to Example E combined with Example 3. The resulting chocolate had the same sweetness and the same low calorie content as the inulide-containing chocolate of Example 10.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method for preparing a mixture of fructose, glucose and compounds of the general formula $GF_n$, wherein G is glucose and F is fructose and n is an integer, comprising calculated as dry matter 0–10% by weight of G+F+GF,
5–20% by weight of $GF_2$,
5–15% by weight of $GF_3$,
5–15% by weight of $GF_4$,
5–15% by weight of $GF_5$, and
80–25% by weight of $GF_6$ and above, where the mixture is recovered from tubers of Jerusalem artichoke (*Helianthus tuberosus* L.) or from roots of chicory (Cichorium), by means of a method which does not involve any chemical modification of the components of the mixture, by which method the following steps are carried out:

a) the substantially cleaned tubers or roots are cut into cosettes,
b) the cosettes are subjected to extraction with water,
c) the extract, or juice, is treated in a suitable order one or more times by each of the following steps:
   1) addition of $Ca(OH)_2$, to a pH value of 10.5–11.5,
   2) addition of $CO_2$ or phosphoric acid, to a pH value of 8.0–9.5 and
   3) filtration
d ) the juice from step c) is subjected to ion exchange,
e ) the juice from step d) is optionally treated with active carbon,
f) the juice from step d) or e) is optionally concentrated by hyperfiltration,
g) the juice from step d) , e) or f) is optionally evaporated to a syrup, and
h) the syrup is optionally dryed to a powder, characterized by subjecting the juice or syrup during any suitable moment subsequent to step c) but prior to step h) to a physical separation to reduce the amount of fructose, glucose and sucrose, said physical separation being carried out by chromatography or nanofiltration or both.

2. A method as claimed in claim 1, characterized by preparing the mixture in form of a juice or syrup or a dry powder.

3. A method as claimed in claim 1, characterized by the physical separation being carried out by chromatography.

4. A method as claimed in claim 3, characterized by the juice or syrup being subjected to chromatography by using an ion exchange resin and water as eluant, and by subsequently treating the eluted fractions having a low sucrose content in accordance with any subsequent step.

5. A method as claimed in claim 1, characterized by the physical separation being carried out by nanofiltration.

6. A method as claimed in claim 5, characterized by the juice or syrup being nanofiltered and the retentate being treated by one or more steps selected from the group consisting of extraction, ion exchange, treatment with active carbon, concentration by hyperfiltration, evaporation, and drying.

7. A mixture comprising calculated as dry matter

0–10% by weight of G+F+GF,
5–20% by weight of $GF_2$,
5–15% by weight of $GF_3$,
5–15% by weight of $GF_4$,
5–15% by weight of $GF_5$, and
80–25% by weight of $GF_6$ and above, produced in accordance with the method of claim 1.

8. A foodstuff or beverage for animals or human beings prepared by incorporating in a foodstuff or beverage the mixture according to any of the preceeding claims.

* * * * *